US006380174B1

(12) United States Patent
Ju et al.

(10) Patent No.: US 6,380,174 B1
(45) Date of Patent: Apr. 30, 2002

(54) SLIME-REMOVING COMPOSITION FOR PAPER MANUFACTURE AND METHOD OF CONTROLLING SLIME USING THE SAME

(75) Inventors: Hong-Shin Ju; Won-Seong Song, both of Taejon (KR)

(73) Assignee: SK Corporation, Seoul (KR)

( * ) Notice: Subject to any disclaimer, the term of this patent is extended or adjusted under 35 U.S.C. 154(b) by 0 days.

(21) Appl. No.: 09/652,464

(22) Filed: Aug. 31, 2000

(30) Foreign Application Priority Data

Dec. 24, 1999 (KR) ..... 99-62106

(51) Int. Cl.[7] ..... A61K 31/66; A01N 57/26
(52) U.S. Cl. ..... 514/75; 514/76
(58) Field of Search ..... 514/272, 75, 76

(56) References Cited

U.S. PATENT DOCUMENTS 5,157,045 A * 10/1992 Hsu ..... 514/372

FOREIGN PATENT DOCUMENTS

RU 2133256 * 7/1999

* cited by examiner

*Primary Examiner*—Alton Pryor
(74) *Attorney, Agent, or Firm*—Abelman, Frayne & Schwab

(57) ABSTRACT

Disclosed is a slime-removing composition comprising polyhexamethyleneguanidine phosphate and 2-bromo-2-nitro-1, 3-propanediol, represented by the following formulas I and II, respectively. With a synergistic effect, the composition has potent sterilizing activity against a broad spectrum of microorganisms which cause the formation of slime during paper manufacture, including bacteria and fungi. In addition to being excellent in rapid action and persistency of the sterilizing activity, the composition generates resistant mutants at an extremely low frequency, so that there can be obtained an economical favor of maintaining high antimicrobial activity even at a small amount. Also, by virtue of the availability in various phases, numerous applications of the microbicide exist in the various industries including cooling water and sterilizer industries in addition to paper and pulp making industries.

(I)

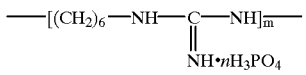

(II)

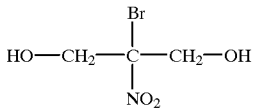

wherein m is an integer of 4 to 7 and n is an integer of 1 to 14.

7 Claims, No Drawings

SLIME-REMOVING COMPOSITION FOR PAPER MANUFACTURE AND METHOD OF CONTROLLING SLIME USING THE SAME

BACKGROUND OF THE INVENTION

1. Field of the Invention

The present invention relates to a slime-removing composition useful for paper manufacture. More particularly, the present invention relates to a slime-removing composition which has potent anti-bacterial and anti-fungal activity against a broad spectrum of microorganisms which causes the formation of slime on the process line of paper manufacture. Also, the present invention is concerned with a method for controlling the formation of slime during paper manufacture by use of the slime-removing composition.

2. Description of the Prior Art

In manufacturing paper, various raw materials and additives are used depending on the kinds of final products, and fundamentally, copious water is employed to mix the raw materials. This mixing process is conducted under a condition of 30° C. and nearly neutral pH, which is suitable for microorganisms to grow. In addition, the materials used in paper manufacture are nutritious (in organic and inorganic aspects) enough for microorganisms to grow and proliferate, so that slime is formed periodically as a result of the inhabitation of microorganisms, disrupting the effective operation of paper manufacture. Particularly, microorganisms take advantage of various organic materials contained in white water for their proliferation, secreting polysaccharides. These polymeric materials secreted are combined with various organic and inorganic materials to form slime, a viscous mass. The slime is apt to form when the flow of fluid is weakened, especially on pipes or chests to which microorganisms readily adhere. The microorganisms causative of the slime formation are exemplified by bacteria, such as Pseudomonas spp. and Bacillus spp., which usually come from the air, clear water and recirculating white water, and by fungi, such as Aspergillus spp. and Candida spp., which usually come from additives used in paper manufacture, such as mineral slurries, paper coating agents, etc.

Recent changes in the conditions for paper manufacture have had a tendancy to aggravate the slime formation. For example, first, a high reuse rate of white water increases the quantity of the organic and inorganic materials dissolved therein and the temperature of the white water while decreasing dissolved oxygen, so that anaerobic microoganisms thrive to make the slime formation serious, giving offensive odor. Next, shortening or lengthening of the purging interval during the paper manufacture brings about an increase in the quantity of organic and/or inorganic materials accumulated, aggravating the slime formation. Finally, the recycling of waste paper makes the microbes flourish because the waste paper itself can be used as a nutrient of the microbes. Further, the remains of additives used in the recycling of waste paper lead slime-controlling agents to inactivation, resulting in the aggravation of the slime formation.

Accumulation of slime on paper-manufacturing process lines causes fouling, plugging, deposition and odors so as to lower the productivity and workability of paper manufacture, discolor the final products, and make them more impure and offensively odorous. Above all, most problematic are the deterioration of pulp and the occurrence of paper cutting which causes the interruption of operation, giving rise to a waste of time and a reduction in equipment efficiency. In result, the accumulation of slime incurs a significant economical loss directly and indirectly.

As mentioned above, examples of the microorganisms which can form slime on paper manufacturing lines are various, including bacteria, such as Pseudomonas spp. and Bacillus spp., and fungi, such as Aspergillus spp. and Penicillium spp. In order to control such slime-causing microorganisms, isothiazoline-based or brome-based compounds have been conventionally used as slime-removing agents. These slime-removing agents based on single compounds, however, are not superior in rapid antibacterial and antifungal activity nor potent in sterilizing activity against a broad spectrum of a bacteria and fungi. For example, as for 2,2-dibromo-3-nitrilepropionamide (DBNPA), which is a brome compound, an amount of 5 ppm is necessary for showing the sufficient sterilizing activity after 24 hours, but elicitation of early sterilization (after 3 hours) requires an amount of 50 ppm (Society for Antibacterial and Antifungal Agents, Japan, Antibacterial and Antifungal Agent Dictionary p142, 1986). Isothiazoline compounds, when being used alone for a long period of time, have a side effect of mutating the slime-causing microorganisms, especially such as Pseudomonas spp., into resistant ones to increase the slime formation. To solve this problem, various slime-removing agents are in turn used or gradually higher concentrations thereof are added with more frequent addition rounds. However, the employment of various slime-removing agents is somewhat cumbersome and the workers come to be exposed to more dangerous conditions when higher concentrations are added. During the operation of paper manufacture processes, moreover, the slime-controlling agents added become poor in rapid action and persistency due to the continuous stream characteristic of paper manufacture. This problem can be avoided by feeding slime-controlling agents into two or more sites of the process line or at higher concentrations. However, this physical management is accompanied by the lowering of productivity and workability and the incurrence of an economical loss.

Polyhexamethyleneguanidine phosphate is an antimicrobial agent which is of excellent rapid action and low toxicity without giving odor, but is found to be relatively poor in the persistency of antimicrobial activity.

SUMMARY OF THE INVENTION

Leading to the present invention, the intensive and thorough research on the removal of slime formed on paper manufacture process lines, repeated by the present inventors aiming to kill slime-causing microorganisms with economical effectiveness, resulted in the finding that a combination of polyhexamethyleneguanidine phosphate and 2-bromo-2-nitro-1,3-propanediol shows effective antimicrobial activity against a broad spectrum of microbes, including bacteria and fungi, with excellency in both rapid antimicrobial activity and persistency.

Therefore, it is an object of the present invention to provide a slime-removing composition useful for paper manufacture, which is of low toxicity with high sterilizing activity against a broad spectrum of microorganisms, including bacteria and fungi.

It is another object of the present invention to provide a method for controlling slime by means of such a composition.

In accordance with an embodiment of the present invention, there is provided a slime-removing composition useful for paper manufacture, comprising a mixture of polyhexamethyleneguanidine phosphate and a 2-bromo-2-nitro-1, 3-propanediol, represented by the following formulas I and II, respectively, at a weight ratio of 1:1 to 1:16 polyhexamethyleneguanidine phosphate:2-bromo-2-nitro-1,3-propanediol.

(I)

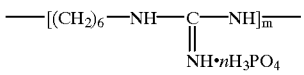

(II)

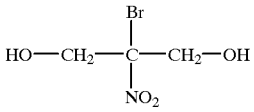

wherein m is an integer of 4 to 7 and n is an integer of 1 to 14.

In accordance with another embodiment of the present invention, there is provided a method for controlling the formation of slime in paper-manufacturing processes, in which the slime-removing composition is fed an amount of 20 to 1,000 ppm with intervals of 8 to 24 hours to the pipes and chests of the paper-manufacturing processes.

DETAILED DESCRIPTION OF THE INVENTION

In the present invention, a slime-removing composition is prepared by mixing a polyhexamethyleneguanidine phosphate of Formula I with 2-bromo-2-nitro-1,3-propanediol of Formula II at a weight ratio of 1:1 to 1:16. When the weight ratio of 2-bromo-2-nitro-1,3-propanediol to polyhexamethyleneguanidine phosphate is below 1 or over 16, the resulting slime-removing compositions are poor in sterilizing activity against microorganisms causative of slime. The slime-removing composition of the present invention may exist in a powder phase or a liquid phase. A powder phase of the slime-removing composition can be obtained by mixing polyhexamethyleneguanidine phosphate powder and 2-bromo-2-nitro-1,3-propanediol powder at a weight ratio of 1:1 to 1:16. As for the liquid phase, an aqueous solution comprising 25 wt % of polyhexamethylene phosphate may be combined with an aqueous solution comprising 25 wt % of 2-bromo-2-nitro-1,3-propanediol at a weight ratio of 1:1 to 1:16 polyhexamethyleneguanidine phosphate:2-bromo-2-nitro-1,3-propanediol.

To obtain maximal sterilizing effects, the slime-removing composition of the present invention is fed where slime is formed frequently, with unaided hands or with the aid of an automatic scale feeder. The slime-removing composition is preferably fed at an amount of 20 to 1,000 ppm. For example, when the amount of the slime-removing composition is below 20 ppm, the sterilizing effect on the slime-causing microorganisms is not large enough to kill the microorganisms. On the other hand, larger than 1,000 ppm of the slime-removing composition has a negative influence on the safety and workability of workers. Preferable amounts of a powder of the slime-removing composition fall within the range of 20 to 200 ppm and when existing as a liquid phase, the composition is preferably added at an amount of 50 to 1,000 ppm.

It is recommended that the slime-removing composition of the present invention be used at intervals of 8 to 24 hours lest resistant strains should be effectively prevented from occurring upon long-term use.

The slime-removing composition of the present invention finds the application of regulating microorganisms in the various industries including cooling water and sterilizer industries in addition to paper and pulp making industries. Particularly, the slime-removing composition of the present invention is useful for paper manufacture and may be used as an antiseptic or preservative for additives useful in paper manufacture.

A better understanding of the present invention may be obtained in light of the following examples which are set forth to illustrate, but are not to be construed to limit the present invention.

EXAMPLE 1

Preparation of Slime-Removing Compositions

Polyhexamethyleneguanidine phosphate powder and 2-bromo-2-nitro-1,3-propanediol powder were mixed at weight ratios of 1:1, 1:2, 1:4, 1:8 and 1:16, respectively to give slime-removing compositions in a powder phase.

A solution of polyhexamethyleneguanidine phosphate in water (active ingredient 25 wt%) and a solution of 2-bromo-2-nitro-1, 3-propanediol in water (active ingredient 25 wt %) were mixed at weight ratios of 1:1, 1:2, 1:4, 1:8 and 1:16, respectively to give slime-removing compositions in a liquid phase.

EXAMPLE 2

Synergistic Effect of Active Ingredients of Slime-Removing Composition

The active ingredients of the slime-removing compositions prepared in Example 1 were tested to evaluate their synergistic effect. A microorganism (Pseudomonas aeruginosa) was cultured at 30° C. for 1 to 3 days in media containing various concentrations of the slime-removing compositions with weight ratios of ingredients. The turbidity of the media was observed with the naked eye to determine the minimal concentrations of the slime-removing compositions, at which the bacteria were inhibited from growing. Minimal growth-inhibitory concentrations (MIC) were also obtained when polyhexamethyleneguanidine phosphate and 2-bromo-2-nitro-1, 3-propanediol were used alone, as controls.

The synergistic effects of the antimicrobial activity of the slime-removing compositions were calculated according to the following mathematical equation, which is disclosed in Kull, F. C., *Appl. Microbiol.* 9:538–541 (1961).

$$\textit{Synergistic Index (SI)} = \frac{Q_a}{Q_A} + \frac{Q_b}{Q_B}$$

wherein $Q_A$ is an MIC of A microbicide when it is used alone, $Q_B$ is an MIC of B microbicide when it is used alone, $Q_a$ is an MIC of A microbicide when it is used in combination with B antibiotics, and $Q_b$ is an MIC of B microbicide when it is used in combination with A microbicide.(A: Polyhexamethyleneguanidine phosphate (PHMG), B: 2-Bromo-2-nitro-1,3-propanediol)

When the SI value is calculated as being larger than 1, the ingredients are determined to show antagonistic activity against each other. On the other hand, the SI value smaller than 1 means that the ingredients are of synergistic activity. The results are given in Table 1, below.

TABLE 1

Synergistic Effects of the Antimicrobial Ingredients of Slime-Removing Compositions on *Pseudomonas aeruginosa*

| Wt. Ratio(A:B) | $Q_a$ | $Q_b$ | $Q_A$ | $Q_B$ | $Q_a/Q_A$ | $Q_b/Q_B$ | SI |
|---|---|---|---|---|---|---|---|
| 1:0 | 0 | 32 | 64 | 32 | 0 | 1 | 1 |
| 1:1 | 25.6 | 6.4 | 64 | 32 | 0.40 | 0.20 | 0.60 |
| 1:2 | 21.3 | 10.7 | 64 | 32 | 0.33 | 0.33 | 0.66 |
| 1:4 | 16 | 16 | 64 | 32 | 0.25 | 0.50 | 0.75 |
| 1:8 | 10.7 | 21.3 | 64 | 32 | 0.17 | 0.67 | 0.84 |
| 1:16 | 6.4 | 25.6 | 64 | 32 | 0.10 | 0.80 | 0.90 |
| 0:1 | 64 | 0 | 64 | 32 | 1 | 0 | 1 |

$Q_A$: MIC (ppm) of an aqueous PHMG solution (active ingredient 25 wt %) when it was used alone
$Q_B$: MIC (ppm) of an aqueous 2-bromo-2-nitro-1,3-propanediol solution (active ingredient 25 wt %) when it was used alone
$Q_a$: MIC (ppm) of an aqueous PHMG solution (active ingredient 25 wt %) when it was used in a mixture
$Q_b$: MIC (ppm) of an aqueous 2-bromo-2-nitro-1,3-propanediol solution (active ingredient 25 wt %) when it was used in a mixture As apparent from Table 1, when the two ingredients were combined, synergistic effects were obtained (SI<1). In addition, the slime-removing compositions exhibited more excellent sterilizing activity at the various weight ratios of the ingredients than did the ingredients alone. Further, even when the amount of 2-bromo-2-nitro-1,3-propanediol was reduced into one fifth, equal or better antibacterial activity was obtained from the slime-removing composition comprising the two ingredients at equal amounts.

Therefore, when being combined with each other, the two antibiotic ingredients showed more potent antimicrobial activity even at their less amounts than when being used alone.

EXAMPLE 3

Antibiotic Activity of Slime-Removing Composition Over Various Microorganisms A composition comprising a weight ratio of 1:1 an aqueous polyhexamethyleneguanidine phosphate solution (active ingredient 25 wt %): an aqueous 2-bromo-2-nitro-1,3-propanediol solution (active ingredient 25 wt %) was evaluated for its MIC values against various strains responsible for the formation of slime. For comparison, the aqueous polyhexmamethyleneguanidine phosphate solution (active ingredient 25 wt %) alone was used as a control. The MIC values were determined by observing the turbidity of the culture media with the naked eye. The results are given in Table 2, below.

TABLE 2

MIC Against Microorganisms (unit:ppm)

| Strains | A | B |
|---|---|---|
| *Escherichia coli* | 32 | 16 |
| *Sphaerotilus natans* | 32 | 16 |
| *Bacillus subtilis* | 32 | 16 |
| *Fusarium oxysporum* | 64 | 8 |

TABLE 2-continued

MIC Against Microorganisms (unit:ppm)

| Strains | A | B |
|---|---|---|
| *Penicillium pinophilum* | 225 | 16 |
| *Aspergillus niger* | 256 | 32 |

A:Polyhexamethyleneguanidine phosphate solution (active ingredient 25 wt %)
B:Mixture of polyhexamethyleneguanidine phosphate and 2-bromo-2-nitro-1,3-propanediol It is apparent that combinations of the two ingredients show more potent sterilizing activity against a broader spectrum of microorganisms, including bacteria and fungi than does each of them alone because they exert synergistic action on each other. This synergistic antimicrobial effect enables the slime-removing composition to be effective even at small amounts in controlling the microorganisms causative of the formation of slime on paper manufacture process lines, incurring an economical favor. In addition, the slime-removing composition of the present invention can be effectively applied for preventing various additives for use in paper manufacture from being contaminated with microorganisms, especially fungi such as Candida spp. and Aspergillus spp.

EXAMPLE 4

Rapid Action and Persistency of Antimicrobial Activity

A mixture of microorganisms responsible for the formation of slime in paper manufacture (*Pseudomonas aeruginosa, Bacillus subtilis, Sphaerotilus natans, Beggiatoa alba*) was inoculated at a density of $10^3$ cfu/ml in nutrient broths (Difco Co.) which were then added with the same slime-removing composition as used in Example 3 and with a polyhexamethyleneguanidine phosphate solution (active ingredient 25 wt %) at concentrations of 25, 50, 100 and 200 ppm, respectively. Immediately (0 hour), three hours, six hours, 24 hours, two days, four days, seven days, 14 days, 21 days, 28 days, and 35 days after the addition, the cultures were measured as to the numbers of microorganisms they retained. Secondary inoculum samples taken from the cultures three weeks (on 22 days) after the addition were re-inoculated at a density of about $10^3$ cfu/ml in the same media as above to determine whether mutants resistant to the compounds were generated according to the long term use of the slime-removing composition. The change in the number of microorganisms was monitored for various concentrations of the slime-removing composition of the present invention and for polyhexamethyleneguanidine phosphate alone against the time lapse. The results are given in Tables 3 and 4.

TABLE 3

Time-Dependent Behavior in Number of Microorganisms at Various Concentrations of Slime-Removing Composition unit: CFU/ml

| Amount | Time | | | | | | | | | | | | |
|---|---|---|---|---|---|---|---|---|---|---|---|---|---|
| (ppm) | 0 | 3h | 6h | 24h | 48h | 72h | 96h | 7d | 14d | 21d | 23d | 28d | 35d |
| Control | 1000 | >1000 | >1000 | >1000 | >1000 | >1000 | >1000 | >1000 | >1000 | >1000 | >1000 | >1000 | >1000 |
| 25 | 1000 | 0 | 0 | 0 | 0 | 0 | 1 | 0 | 88 | 0 | 3 | 3 | 1 |
| 50 | 1000 | 9 | 1 | 0 | 0 | 1 | 0 | 0 | 0 | 0 | 7 | 8 | 5 |
| 100 | 1000 | 0 | 0 | 0 | 0 | 0 | 0 | 0 | 0 | 0 | 3 | 1 | 1 |
| 200 | 1000 | 1 | 0 | 0 | 0 | 0 | 0 | 0 | 0 | 0 | 2 | 1 | 2 |

TABLE 4

Time-Dependent Behavior in Number of Microorganisms at Various Concentrations of Polyhexamethyleneguanidine phosphate unit: CFU/ml

| Amount | Time | | | | | | | | | | | | |
|---|---|---|---|---|---|---|---|---|---|---|---|---|---|
| (ppm) | 0 | 3h | 6h | 24h | 48h | 72h | 96h | 7d | 14d | 21d | 23d | 28d | 35d |
| Control | 1000 | >1000 | >1000 | >1000 | >1000 | >1000 | >1000 | >1000 | >1000 | >1000 | >1000 | >1000 | >1000 |
| 25 | 1000 | 0 | 0 | 0 | 162 | 77 | 769 | 185 | 610 | 71 | 310 | 340 | 842 |
| 50 | 1000 | 0 | 0 | 0 | 1 | 7 | 129 | 50 | 1 | 1 | 86 | 93 | 115 |
| 100 | 1000 | 0 | 0 | 0 | 8 | 0 | 98 | 4 | 0 | 0 | 4 | 0 | 1 |
| 200 | 1000 | 0 | 0 | 0 | 0 | 0 | 12 | 0 | 1 | 0 | 1 | 0 | 0 |

As indicated in Tables 3 and 4, polyhexmethyleneguanidine phosphate alone showed effective fast sterilizing activity (rapid action), but was poor in persistency as microorganisms began to proliferate after 48 hours. In addition, when polyhexamethyleneguanidine phosphate was used alone, mutant microrganisms were generated as demonstrated by the growth of the secondary inocula. In contrast, the slime-removing composition of the present invention was found to show good rapid sterilizing action even at small quantities and keep the antimicrobial activity high during a long period of time. Further, upon the re-inoculation, the slime-removing composition exerted high sterilizing activity on the microorganisms.

EXAMPLE 5

Application for Paper Manufacture and Sterilizing Effect of Slime-Removing Composition To white water for paper manufacture, which contained microorganisms at a density of larger than $10^6$ cfu/ml, the same slime-removing composition as used in Example 3 was fed at amounts of 20, 50, 100 and 200 ppm, respectively. For comparison, 2-bromo-2-nitro-1,3-propanediol was used as a control. At a certain point of time (6 and 12 hours) after the feeding, samples were taken from the white water to count the numbers of microorganisms present therein. The results are given in Table 5, below.

TABLE 5

Sterilizing Activity Change of Sime-Removing Composition According to Time

| Amount | Initial | After 6 hrs | | After 48 hrs | |
|---|---|---|---|---|---|
| (ppm) | (0 hr) | A | B | A | B |
| Control | $7.9 \times 10^6$ | $>1 \times 10^6$ | $>1 \times 10^6$ | $>1 \times 10^6$ | $>1 \times 10^6$ |
| 20 ppm | $7.9 \times 10^6$ | $1.2 \times 10^4$ | $>1 \times 10^6$ | $1.3 \times 10^2$ | $>1 \times 10^6$ |
| 50 ppm | $7.9 \times 10^6$ | $5.4 \times 10^2$ | $>1 \times 10^6$ | $2.5 \times 10^2$ | $1.1 \times 10^5$ |
| 100 ppm | $7.9 \times 10^6$ | $8.2 \times 10^2$ | $5.7 \times 10^4$ | $4.5 \times 10^2$ | $3.3 \times 10^4$ |
| 200 ppm | $7.9 \times 10^6$ | $5.0 \times 10^2$ | $4.1 \times 10^4$ | $1.0 \times 10^2$ | $6.3 \times 10^3$ |

A: mixture of polyhexamethyleneguanidine phosphate solution (active ingredient 25 wt %) and 2-bromo-2-nitro-1,3-propanediol (weight ratio 1:1)
B: 2-bromo-2-nitro-1,3-propanediol alone As seen in Table 5, a surprising reduction was found in the number of microorganisms six hours after the application of the slime-removing composition of the present invention. On the contrary, the number of microorganisms was maintained at the same order at 6 hours after the application of the control, demonstrating that 2-bromo-2-nitro-1,3-propanediol alone is poor in exerting its antimicrobial activity within a short period of time. 48 hours after the application, the number of the microorganisms was maintained as low as at 6 hours after the application when the slime-removing composition was used while 2-bromo-2-nitro-1,3-propanediol alone could not bring about a significant reduction in the number of microorganisms. Consequently, combinations of polyhexamethyleneguanidine phosphate and 2-bromo-2-nitro-1, 3-propanediol are superior in the rapid action and persistency of sterilizing activity to 2-bromo-2-nitro-1,3-propanediol alone.

As described hereinbefore, the slime-removing composition of the present invention has potent sterilizing activity against a broad spectrum of microorganisms, including bacteria and fungi. In addition to being far superior in rapid action and persistency of the sterilizing activity to ingredients alone, the slime-removing composition generates resistant mutants at an extremely low frequency, so that there can be obtained an economical favor in that the slime-removing composition maintains high antimicrobial activity even at a small amount. Further, together with less toxicity, the more potent activity of the microbicide may be advantageous to the health of the workers because of the employment of less amount or may be helpful in raising the production yield because of the reduction of the feeding rounds of the microbicide. Moreover, the availability of the less toxic slime-removing composition in various phases such as a powder phase and a liquid phase makes the microbicide of the present invention find the application of regulating microorganisms in the various industries including cooling water and sterilizer industries in addition to paper and pulp making industries. Particularly, with the advantages of being low in corrosion and toxicity and hardly foaming, polyhexamethyleneguanidine phosphate used in the present invention can be usefully applied to pipes or chests, the places at which slime frequently forms.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A slime-removing composition useful for paper manufacture, comprising a synergistic mixture of polyhexamethyleneguanidine phosphate, represented by the following formula I:

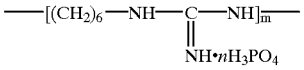

(I)

wherein m is an integer of 4 to 7 and n is an integer of 1 to 14; and 2-bromo-2-nitro-1,3-propanediol, represented by the following formula II:

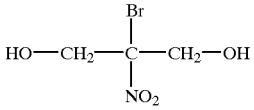

(II)

at a weight ratio of 1:1 to 1:16 polyhexamethyleneguanidine phosphate:2-bromo-2-nitro-1,3-propanediol.

2. The slime-removing composition as set forth in claim 1, wherein the mixture of polyhexamethyleneguanidine phosphate and 2-bromo-2-nitro-1,3-propanediol is in a powder phase or a liquid phase.

3. The slime-removing composition as set forth in claim 2, wherein the mixture is in a liquid phase, consisting of an aqueous polyhexamethyleneguanidine phosphate solution and an aqueous 2-bromo-2-nitro-1,3-propanediol solution, both solutions containing the active ingredients, respectively, at an amount of 25 weight %.

4. A method for controlling the formation of slime in paper-manufacturing processes, in which the composition comprises a synergistic mixture of polyhexamethyleneguanidine phosphate, represented by the following formula I:

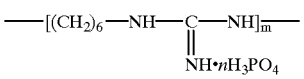

(I)

wherein m is an integer of 4 to 7 and n is an integer of 1 to 14; and 2-bromo-2-nitro-1,3-propanediol, represented by the following formula II:

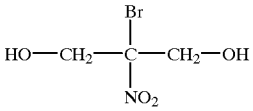

(II)

at a weight ratio of 1:1 to 1:16 polyhexamethyleneguanidine phosphate:2-bromo-2-nitro-1,3-propanediol, is fed at an amount of 20 to 1,000 ppm with intervals of 8 to 24 hours to the pipes and chests of the paper-manufacturing processes.

5. The method as set forth in claim 4, wherein the mixture of polyhexamethyleneguanidine phosphate and 2-bromo-2-nitro-1, 3-propanediol is in a powder phase or a liquid phase.

6. The method as set forth in claim 5, wherein the mixture is used at an amount of 20 to 200 ppm in a powder phase and at an amount of 50 to 1,000 ppm in a liquid phase.

7. The method as set forth in claim 5, wherein the mixture is in a liquid phase, consisting of an aqueous polyhexamethyleneguanidine phosphate solution and an aqueous 2-bromo-2-nitro-1,3-propanediol solution, both solutions containing the active ingredients, respectively, at an amount of 25 weight %.

* * * * *